US011134754B2

(12) United States Patent
Sjöstrand

(10) Patent No.: US 11,134,754 B2
(45) Date of Patent: Oct. 5, 2021

(54) METAL EYELET

(71) Applicant: Carmo Holding ApS, Espergaerde (DK)

(72) Inventor: Olof Sjöstrand, Helsingborg (SE)

(73) Assignee: Carmo Holding ApS, Espergaerde (DK)

( * ) Notice: Subject to any disclaimer, the term of this patent is extended or adjusted under 35 U.S.C. 154(b) by 55 days.

(21) Appl. No.: 16/701,064

(22) Filed: Dec. 2, 2019

(65) Prior Publication Data

US 2020/0170355 A1 Jun. 4, 2020

(30) Foreign Application Priority Data

Nov. 30, 2018 (EP) ..... 18209388

(51) Int. Cl.
*A44B 17/00* (2006.01)
*A44B 13/00* (2006.01)
*E04H 15/64* (2006.01)

(52) U.S. Cl.
CPC ..... *A44B 13/0076* (2013.01); *E04H 15/64* (2013.01)

(58) Field of Classification Search
CPC ..... A44B 13/0076; A44B 17/0023; A44B 17/0011; E04H 15/64; Y10T 24/4775;
(Continued)

(56) References Cited

U.S. PATENT DOCUMENTS 257,750 A * 5/1882 Parcelle ..... F16L 5/00 16/2.1
1,334,163 A * 3/1920 Neuberth ..... A43C 5/00 24/713.7

(Continued)

FOREIGN PATENT DOCUMENTS

| | | | |
|---|---|---|---|
| DE | 1457494 | A1 | 2/1969 |
| EP | 1673994 | A1 | 6/2006 |
| GB | 1052413 | A | 12/1966 |

*Primary Examiner* — Jason W San
(74) *Attorney, Agent, or Firm* — Carl A. Morales; Todd K. Macklin; Dechert LLP

(57) ABSTRACT

The present invention relates to an eyelet (100) for a flexible sheet such as a tarpaulin, canvas, foil or linen, the eyelet (100) forming a generally round loop having a central aperture (1) suitable for receiving a rope. The eyelet (100) comprises a metal body (110) comprising a cylindrical section (119) comprising a first end (111) and a second end (112). The first end (111) is provided with a radially extending first flange (113) extending towards the second end (112). The second end (112) is provided with a radially extending second flange (114) extending towards the first end (111). A partly confined space (115) is formed by the first (113) and second flange (114) and the cylindrical section (119). The eyelet further comprises a plastic body (120) enclosing the metal body (110), whereby the plastic body (120) is securely joined to the metal body (110) due to plastic at least occupying the partly confined space (115). The plastic body (120) further has a radially extending plastic flange (121), thereby providing means for joining the eyelet (100) to the flexible sheet. Thereby, the eyelet experiences an improved inherent strength and improved attachment. Further, the eyelet provides a means—through the provision of an integral plastic flange—for attaching a flexible sheet to the eyelet by means of welding, melting, gluing or fusion of the two materials.

20 Claims, 4 Drawing Sheets

(58) Field of Classification Search
CPC ..... Y10T 24/45785; Y10T 24/45775; Y10T 24/3657; Y10T 24/366; A44D 2201/04; A44D 2201/06
See application file for complete search history.

(56) References Cited

U.S. PATENT DOCUMENTS 1,536,767 A * 5/1925 Carter ..... F16B 39/286 411/213
1,831,202 A * 11/1931 Simons ..... A44B 17/0082 24/671
2,799,910 A * 7/1957 Weber ..... A44B 17/0082 24/681
2,986,790 A * 6/1961 Silver ..... A44B 17/0088 24/95
3,162,920 A * 12/1964 Durham ..... E04H 15/64 24/265 R
3,979,798 A 9/1976 Meyer
4,180,899 A * 1/1980 Mikosinski ..... A44B 1/44 24/691
4,372,013 A * 2/1983 Gautier, Jr. ..... A43C 5/00 16/2.1
D277,642 S * 2/1985 Hinsperger ..... D21/839
4,644,610 A * 2/1987 Fish ..... A01G 13/04 211/70.6
4,682,447 A * 7/1987 Osborn ..... A01G 20/40 52/3
4,697,312 A * 10/1987 Freyer ..... B65D 33/1625 24/30.5 R
5,074,014 A * 12/1991 Freeman ..... E04H 15/64 24/714.6
5,167,047 A * 12/1992 Plumley ..... A47B 21/06 16/2.1
5,308,671 A * 5/1994 Wells ..... A41B 11/001 2/245
5,573,825 A * 11/1996 Brewster ..... G09F 7/00 283/75
5,647,107 A * 7/1997 Brewster ..... G09F 7/00 24/713.6
5,685,174 A * 11/1997 Balzer ..... A44B 17/0082 24/578.12
5,769,144 A * 6/1998 Carter ..... A47H 13/02 160/330
5,806,140 A * 9/1998 Carlson ..... G02B 6/4452 16/2.1
5,940,940 A * 8/1999 Tanikoshi ..... A44B 17/0082 24/108
5,973,271 A * 10/1999 Fujita ..... F16L 5/10 174/152 G
6,151,759 A * 11/2000 Harward ..... B63B 32/35 16/444
6,170,131 B1 * 1/2001 Shin ..... A41F 1/002 24/303
6,718,600 B1 * 4/2004 Gillis ..... E04H 15/64 135/119
6,757,945 B2 * 7/2004 Shibuya ..... A47G 27/0418 16/8
8,092,132 B2 * 1/2012 Zink ..... F16B 39/103 411/221
8,327,510 B2 * 12/2012 Schlesinger ..... A41F 17/02 24/459
8,407,868 B2 * 4/2013 Chung ..... A44B 13/0094 24/713.6
9,003,618 B2 * 4/2015 Violato ..... A41F 1/02 24/713.7
9,024,211 B2 * 5/2015 Stathis ..... A47B 97/00 174/650
9,273,707 B2 * 3/2016 Lee ..... A44B 13/0076
9,517,712 B1 * 12/2016 Masanek, Jr. ..... B60N 3/044
9,943,121 B2 * 4/2018 Gellineau ..... A41D 1/002
10,130,148 B1 * 11/2018 Au ..... A44B 17/007
10,165,811 B2 * 1/2019 O'Leary ..... A44C 3/001
10,351,082 B2 * 7/2019 Kim ..... A44B 13/0088
10,862,244 B2 * 12/2020 Sze ..... A43C 7/00
2005/0251971 A1 * 11/2005 Fildan ..... A44B 17/0035 24/114.6
2006/0200954 A1 * 9/2006 Chung ..... A44B 13/0094 24/713.6
2009/0056082 A1 * 3/2009 Quimod ..... A44B 1/04 24/113 R
2012/0060329 A1 * 3/2012 Zhang ..... E06B 9/388 24/115 F
2012/0317760 A1 * 12/2012 Kamiya ..... A44B 1/44 24/591.1
2013/0067696 A1 * 3/2013 Hutchinson ..... B60P 7/0807 24/265 CD
2013/0219656 A1 * 8/2013 Bruce ..... B32B 1/08 16/2.1
2014/0033474 A1 * 2/2014 Violato ..... A44B 13/0082 16/2.1
2014/0137373 A1 * 5/2014 Villa ..... A44B 17/0023 24/108
2014/0144210 A1 * 5/2014 Jyouza ..... B60C 23/00 73/37
2015/0173459 A1 * 6/2015 Yang ..... A44B 13/0076 24/713.2
2015/0327632 A1 * 11/2015 Unger ..... A44B 17/0076 24/615
2016/0115874 A1 * 4/2016 Bandaru ..... F23R 3/06 60/801
2016/0181729 A1 * 6/2016 Barth ..... H01R 13/6277 439/37
2016/0186609 A1 * 6/2016 Holland ..... F16B 5/04 428/223
2017/0156450 A1 * 6/2017 Hutsenpiller ..... A44B 17/0029
2018/0062318 A1 * 3/2018 Sze ..... H01R 13/639
2018/0125167 A1 * 5/2018 You ..... A45C 13/08
2018/0192746 A1 * 7/2018 Yu ..... C08L 23/06
2019/0307195 A1 * 10/2019 Kanazawa ..... A44B 17/0011
2020/0008540 A1 * 1/2020 Yu ..... A44B 13/0076
2020/0329823 A1 * 10/2020 Doan ..... E05B 65/5261

* cited by examiner

METAL EYELET

FIELD OF THE INVENTION

The present invention relates to an eyelet for a flexible sheet such as a tarpaulin, canvas, foil or linen. More specifically, the present invention relates to an eyelet having improved means for integration with a flexible sheet such as a tarpaulin, canvas, foil or linen.

BACKGROUND OF THE INVENTION

Large flexible sheets such as a tarpaulin, canvas, foil or linen are used for a wide range of things and they often need to be fastened during use. An example of a flexible sheet is a tarpaulin which is widely used to cover articles in freight vehicles or warehouses or to cover scaffolds and construction works, so that such articles are protected from rain or sunshine. Generally, a tarpaulin is secured by securing elements such as e.g. ropes, strings, hooks or the like, but due to the risk of tearing, eyelets are provided in corners and/or along edges, allowing for the ropes or strings to pass through. Thus, the eyelets provide a reinforcement of the tarpaulin where the eyelets are positioned.

Typically, such large flexible sheets are made from a synthetic material, e.g. PVC or other polymers. Most importantly, the tarpaulin is made of an appropriate material for the intended use. During the manufacturing process, holes are punched out for receiving the eyelets.

Known eyelets include metal eyelets made from e.g. aluminium, brass or steel and hard plastic eyelets, both made by using an upper mould and a lower part. Commonly, a metal eyelet comprises a lower cylindrical body and an upper disc, the lower cylindrical body having a bottom plate and a cylinder placed upwardly on the bottom plate. The upper disc has a generally round ring formed in the intermediate portion thereof, the round ring being concave at the inside thereof, and further has a flange turned over around the outer periphery thereof. After the hole for the eyelet is formed in the tarpaulin fabric, the lower cylindrical body and the upper disc are coupled in said hole in a procedure similar to rivets. As a result, the lower cylindrical body and the upper disc are formed as an integral body with each other and mounted on the tarpaulin fabric. The securing element, which is used for fixing the tarpaulin fabric, is passed through the inside of the hole formed in the centre portion of the eyelet, such that the tarpaulin fabric can be fixed to a given object.

Generally, the hard plastic eyelet has the same structure as the metal eyelet, except that a plurality of protrusions of a predetermined thickness are formed in a shape of a circle on the top surface of the bottom plate of the lower cylindrical body and on the bottom surface of the upper disc. The protrusions are inserted into the tarpaulin fabric upon coupling of the eyelet with the tarpaulin fabric, thereby achieving the rigid attachment of the eyelet to the tarpaulin fabric.

However, such conventional types of eyelets have several disadvantages. Most importantly, due to conventional eyelets comprising two bodies being coupled, a risk of subsequent detachment is present. Further, since conventional eyelets rely on the clamping of the tarpaulin between the two bodies, the force by which said bodies are coupled is critical. However, one cannot couple the bodies by a force exceeding the breaking points of the materials constituting said bodies, and as such, is limited by the material choice. Further, conventional eyelets are likely to tear the tarpaulin if pulled, as the eyelets may considered a foreign object in the tarpaulin with a low degree of integration. Finally, the size of conventional eyelets is considerable, as these rely on the before-mentioned two bodies.

GENERAL DESCRIPTION

The object of the invention is to solve some of the above-mentioned problems. According to the invention, an eyelet for a flexible sheet is disclosed, the eyelet forming a generally round loop having a central aperture suitable for receiving a securing element. The eyelet is characterised in that it further comprises a metal body comprising a cylindrical section comprising a first end and a second end, where the first end is provided with a radially extending first flange extending towards the second end, and where the second end is provided with a radially extending second flange extending towards the first end, such that a partly confined space is formed by the first and second flange and the cylindrical section. Further, the eyelet comprises a plastic body enclosing the metal body, whereby said plastic body is securely joined to the metal body due to plastic at least occupying the partly confined space, and wherein the plastic body comprises a radially extending plastic flange, thereby providing means for joining the eyelet to the flexible sheet.

By an eyelet is meant a device providing means for reinforcing a flexible sheet, such as a tarpaulin, canvas, foil or linen, at points where a securing element such as a rope or hook is to be mounted or passed through. The eyelet forms an opening, which can be of any shape, such as e.g. a circular or square having a central aperture. Thus, the eyelet may be considered ring-shaped. The eyelet is to be mounted in a hole in the flexible sheet, such that a securing element being e.g. a rope may be passed through the central aperture and thereby through the flexible sheet. By a rope is meant any type of rope, string, or wire commonly used to attach a flexible sheet to an object. Alternative securing means could be a hook or similar that can be fastened to the aperture of the eyelet.

By metal body is meant an element made of a metal, e.g. aluminium, titanium, steel, brass or other metals commonly used in the field of eyelets. By a cylindrical section is meant that said section generally defines the shape of the eyelet, especially the size of the central aperture. Thus, the cylindrical section is open ended, such that a rope may pass through. Thus, the first end and second end of the cylindrical section is to be understood the terminating ends of the cylindrical section.

By the first and second ends being provided with a first and second radially extending first flange is meant that said flanges extends from the first and second end of the cylindrical section, respectively, and outwards, away from a central axis coinciding with the extension of the cylindrical section. Preferably, the metal body is made from a single piece of metal, where the flanges are formed in a stamping/punching procedure, such that said flanges and central section are integral. By being made of a single piece of metal, the flanges and cylindrical section are considerably stronger than flanges attached onto said cylindrical section by means of e.g. welding. However, one realises that such embodiment is likewise possible within the scope of the invention. Thus, by the term "provided with" is meant that the flanges may either be stamped out from a single piece of material, or be attached the cylindrical section, e.g. by means or welding. In an embodiment, the first and second flanges are provided about the entire circumference of the cylindrical section.

By the first flange extending towards the second end is meant that said flange is bent generally towards the geometrical plane defined by said second end. By the latter is meant that the second end of the cylindrical section generally lies in the same geometrical plane, the plane preferably being normal to the central axis. Thus, the first flange generally extends towards this geometrical plane, but said first flange may be wave shaped, box shaped, straight and angle, partly circular, etc., along this extension. However, the general extension of the first flange is generally towards the second end or the plane defined by said end. For example, the free end of the first flange is positioned at a point between the first end and the second end, or the geometrical planes thereof as understood from the above disclosure. In certain embodiments, the angle formed between the flange and an outer wall of the cylindrical section may be acute, whereby the condition of the extension towards the second end/the geometrical plane defined by said second end is met. In other words, the first flange does not extend the entire way towards the second end. Preferably, the first flange has a length between 5 mm and 30 mm, or more specifically between 8 mm and 20 mm.

Likewise, by the second flange extending towards the first end is meant that said flange is bent towards the geometrical plane defined by said first end. By the latter is meant that the first end of the cylindrical section generally lies in the same geometrical plane, the plane preferably being normal to the central axis. Thus, the second flange generally extends towards this geometrical plane, but said second flange may be wave shaped, box shaped, straight and angle, partly circular, etc., along this extension. However, the general extension of the second flange is generally towards the first end or the plane defined by said end. For example, the free end of the second flange is positioned at a point between the first end and the second end, or the geometrical planes thereof as understood from the above disclosure. The second flange may be U-shaped in cross section in a preferred embodiment, such that the cylindrical section terminates in said flange being bent to form the U-shape, the free end of the U-shape then extending towards the first end and the first flange, the latter being a result of the first flange extending towards the second end. In a preferred embodiment, a projection of the second flange onto the outer wall of the cylindrical section covers 10% to 90% of said wall, or more specifically between 10 and 60%. Thus, the first and second flanges extend towards each other. However, and preferably, said flanges do not cross or touch. In other words, a gap remains between the first and second flanges.

Due to the first and second flanges extending towards each other, a partly confined space is formed about the circumference of the metal body. Thus, the partly confined space is defined by the first and second flanges, the outer wall of the cylindrical section, and the gap between said flanges.

According to the invention, the metal body is enclosed in a plastic body. Thus, the plastic body covers/encapsulates the metal body. Preferably, the plastic body is casted in one piece, e.g. in a procedure wherein the metal body is disposed in a casting mould and molten plastic is added, such that said plastic encapsulates the metal body according to the shape of the mould. The inner wall of the cylindrically section of the metal body may remain free of plastic, or plastic may cover this wall as well. Most importantly, plastic occupies the partly confined space as previously defined, since plastic is allowed to enter this space through the gap between the first and second flanges.

The plastic body further comprises a plastic flange. Preferably, this plastic flange is shaped during the above-described casting procedure, thereby providing the plastic body with an integral plastic flange. The plastic flange is a radially extending flange disposed around the eyelet, such that the entire eyelet (metal body and plastic body combined) is rotationally symmetric about the central axis. The plastic flange should at least extend further than the first flange and/or second flange. Preferably, the flange has a thickness between 2 mm and 6 mm, but may be either thinner or thicker depending on the size of the entire eyelet and as such, the intended use.

The plastic flange of the plastic body provide a means for attaching a flexible sheet to the eyelet by means of welding, melting, gluing or fusion of the two materials. Thus, it is understood that the plastic flange is made of a material being weldable/fusible with a flexible sheet, likewise being made of such a material. Most plastics/polymers provide this opportunity, e.g. PVC.

Thereby, the eyelet experiences an improved inherent strength through the metal body being made in one piece of metal, and an improved attachment between the plastic body and the metal body through the provision of a partly confined space defined by the provision of flanges extending towards each other. Further, the eyelet provides a means—through the provision of an integral plastic flange—for attaching a flexible sheet to the eyelet by means of welding, melting, gluing or fusion of the two materials. Thereby, the eyelet may be considered an integral part of the flexible sheet. The ability to be welded with the flexible sheet increases the strength significantly compared to conventional eyelets. Further, the welded region—the plastic flange—is securely fastened to the metal body through the plastic body further occupying the partly confined space defined by the flanges of the metal body, and as such is less likely to detach or tear the flexible sheet compared to conventional eyelets.

In an embodiment, the first and second flanges and the plastic flange may be rotationally symmetric about a central axis of the eyelet. Alternative shapes could be oval, square, and triangular.

By a central axis of the eyelet is meant a central axis coinciding with the extension of the cylindrical section of the metal body, i.e. a central axis passing through the central aperture of the eyelet.

Thereby, all flanges are disposed along the entire circumference of the eyelet, which improves the strength and increases the welding region.

In an embodiment, the first flange may extend further away from the cylindrical section than the second flange.

Thereby, the first flange overlaps the second flange. Thereby, the gap formed between the two flanges is asymmetric when seen from the side of the eyelet, i.e. normal to the outer wall of the cylindrical section of the metal body. Thereby, detachment of the plastic body from the metal body is less likely to occur in the plane where a flexible sheet is to be welded to the plastic flange. In other words, a pull in the plastic body in a direction normal to the outer wall of the cylindrical section is less likely to cause a detachment from the metal body. One notices that the described direction is the most common direction in which a pull may occur once a flexible sheet is attached.

In an embodiment, the second flange may be substantially U-shaped in cross section.

By a U-shape is meant that the first leg of the U terminates in the central section of the metal body, and that the second leg points towards the first end and as such the first flange.

Thus, the flange is integral with the metal body. In certain embodiments, the end of the second leg of the U may be directed towards the outer wall of the cylindrical section, such that plastic occupying the partly confined space becomes further contained within the U-shape.

Thereby, the plastic body may occupy the U-shape, thereby increasing the resistance to detachment.

In an embodiment, the plastic flange may extend further away from the cylindrical section than the first flange.

In other words, the plastic flange is furthest away from the central axis.

Thereby, the plastic flange may be easily welded/fused with a flexible sheet within affecting the thicker metal body.

In an embodiment, the plastic flange may be planar.

In other words, the plastic flange extends in the same plane. Preferably, said plane may coincide with the plane of the first or second end, whereby the plastic flange forms a base of the eyelet.

Thereby, a flexible sheet may be attached the eyelet in the same plane across said eyelet.

In an embodiment, the plastic flange may comprise ribs.

By ribs is meant surface features/corrugations increasing the surface area of the plastic flange. The ribs may extend radially away from the central axis. Alternatively or additionally, the plastic flange is provided with a ring-shaped rib extending along the circumference of said plastic flange.

Thereby, a flexible sheet may be even more strongly welded with the plastic flange. Especially, Further, the invention relates to a flexible sheet comprising an eyelet according to previous disclosures.

The eyelet is disposed in openings in the flexible sheet and welded along the plastic flange of said eyelet.

Thereby, a flexible sheet comprising a welded eyelet is provided. Due to the welding, the eyelet is strongly attached the flexible sheet, thereby decreasing the risk of tearing if the flexible sheet is exposed to a pull, e.g. due to wind.

BRIEF DESCRIPTION OF THE DRAWINGS

In the following, example embodiments are described according to the invention, where FIG. 1A illustrates a perspective view of eyelet 100; FIG. 1B illustrates a top view of eyelet 100; and FIG. 1C illustrates a cross sectional view of eyelet 100 taken along the line A-A.

FIG. 3A illustrates a perspective view and FIG. 3B illustrates a cross sectional view of flexible sheet 300 comprising eyelet 100.

DETAILED DESCRIPTION OF DRAWINGS

In the following the invention is described in detail through embodiments thereof that should not be thought of as limiting to the scope of the invention.

Figure 1A:
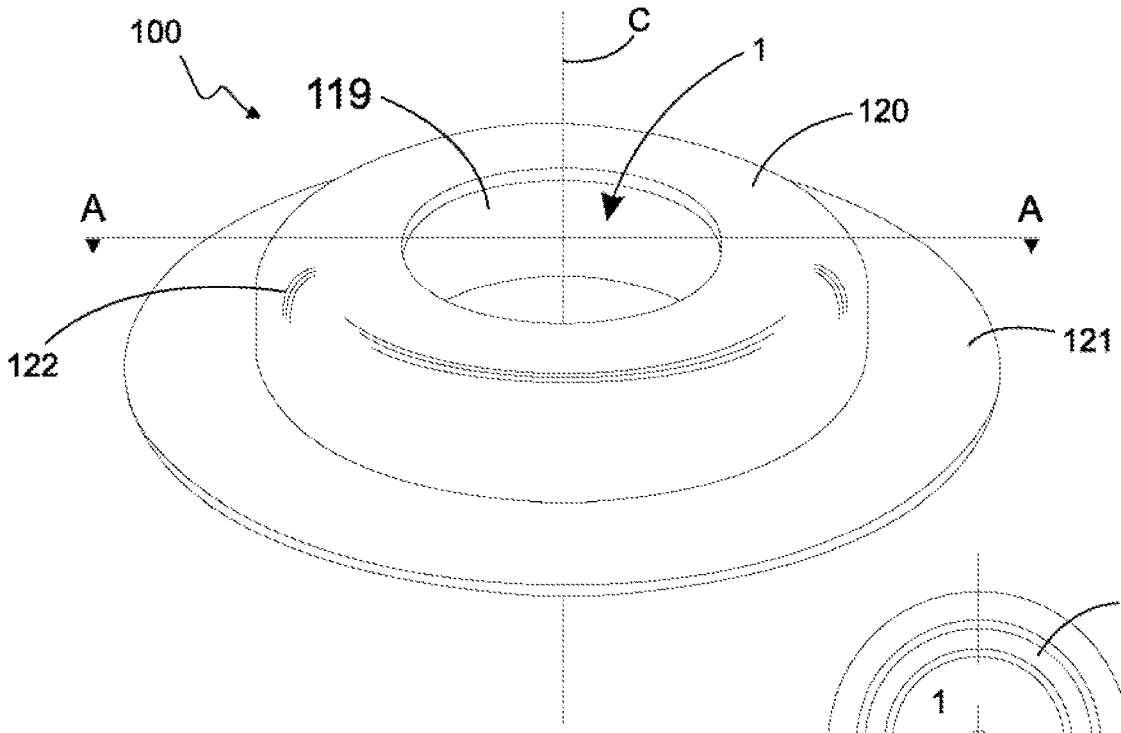
FIGS. 1A-1C illustrate an eyelet according to the invention.
Figure 1B:
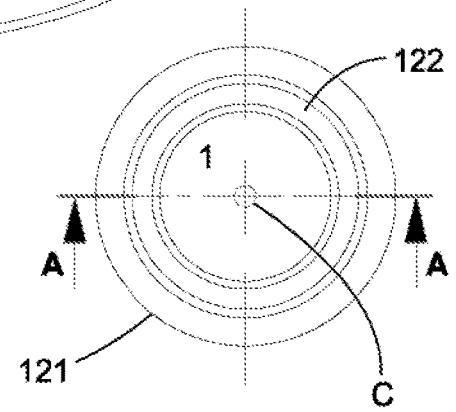
Figure 1C:
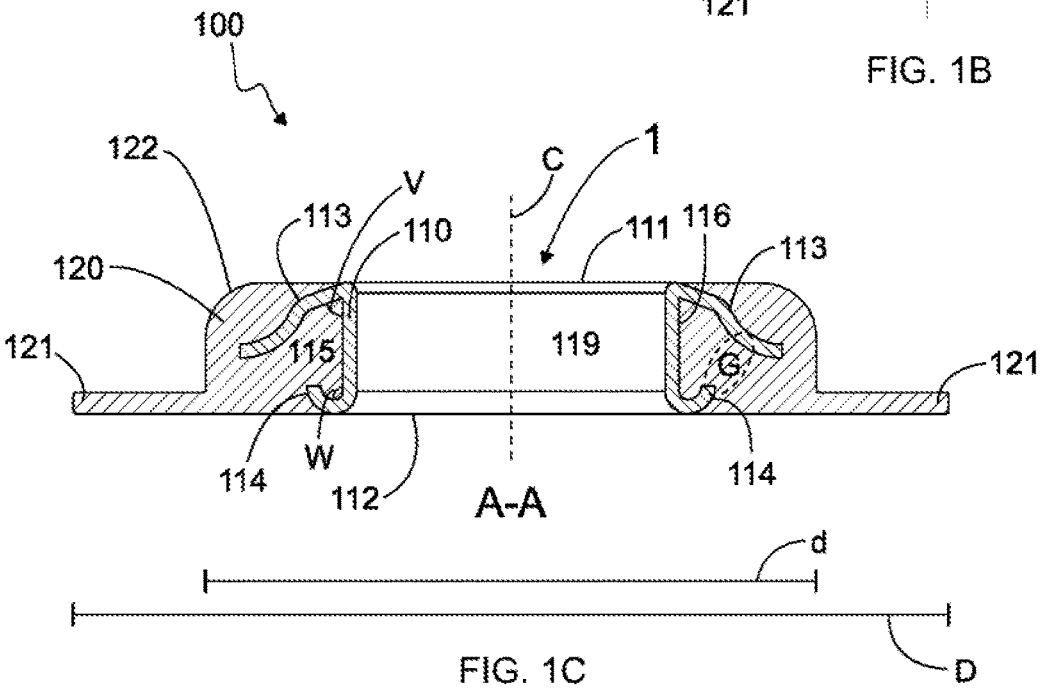

FIGS. 1A-1C illustrate an eyelet 100 according to the invention. FIG. 1A illustrates a perspective view of such an eyelet 100. FIG. 1B illustrates a top view of the eyelet of FIG. 1B. FIG. 1C illustrates a cross sectional view taken along the line A-A indicated in FIG. 1A and FIG. 1B. In the following, attention is mainly drawn to FIG. 1C. The eyelet 100 comprises a metal body 110 and a plastic body 120 enclosing said metal body 110. The eyelet 100 is generally ring-shaped and comprises a through-going central aperture 1, as best realised from FIG. 1A. The central aperture 1 allows for the insertion/passage of a rope/string, such that the rope and a flexible sheet may be connected by means of the eyelet 100. A central axis C passes through the aperture 1. The eyelet 100 in the illustrated embodiment is rotationally symmetric about the central axis C, but alternative shapes are also possible.

The metal body 110 comprises a cylindrical section 119 comprising a first end 111 and a second end 112. The first end 111 is provided with a first flange 113 and the second end 112 is provided with a second flange 114. The flanges 113,114 are radially extending, meaning that they extend radially in a direction away from the central axis C of the eyelet 100.

The first flange 113 extends in a direction towards the second end 112. In certain embodiments, this may be described through the angle V formed between the first flange 113 and the cylindrical section 119. In such certain embodiments, said angle V is acute. The second flange 114 extends in a direction towards the first end 111. In other words, the first flange 113 and the second flange 114 extend towards each other. In certain embodiments, the cross section of the second flange is U-shaped. In other embodiments, the direction of the second flange 114 may be described through the angle W formed between said second flange 114 and the cylindrical section 119. In such other embodiments, said angle W is acute. Thus, the first flange 113 and the second flange 114 define a partly confined space 115 due to said flanges 113,114 extending towards each other. A gap G is formed between the flanges 113,114 allowing the plastic of the plastic body to enter the partly confined space. One notices that the first flange 113 is longer than the second flange 114. Such difference in lengths introduces an asymmetric arrangement of the flanges, such that the gap G is not disposed symmetrically between the first end 111 and second end 112 of the metal body 110. This asymmetry reduces the risk of detachment between the metal body 110 and plastic body 120 in cases where said plastic body 120 is pulled in a direction being normal to the outer wall 116 of the cylindrical section 119.

A plastic body 120 (hatched, FIG. 1C) encloses the metal body 110. The plastic body 120 is provided with a plastic flange 121 being substantially planar and radially extending, orthogonal to the central axis C. Thus, in certain embodiments, the plastic flange 121 may be said to form a base of the eyelet 100, whereas in other embodiments, the plastic flange 121 may be positioned between the first end 111 and the second end 112 of the metal body 110. In any case, the plastic flange 121 extends further away from the central axis C than both the first flange 113 and the second flange 114. Further, the plastic flange 121 has a thickness being smaller than the length of the cylindrical section 119 of the metal body 119, which may be considered the general thickness of the eyelet 100. A shoulder 122 of the plastic body 120 is formed across the first flange 113 of the metal body 110 in order to enclose said first flange 113. In the shown embodiment, the eyelet 100 comprises a first diameter d and a second diameter D, the second diameter D being greater than the first diameter d. The second diameter D reflects the extension of the plastic flange 121, whereas the first diameter d is set by the shoulder 122, and thereby partly by the extension of the first flange 113.

Thereby, the plastic flange 121 may be welded/fused with a flexible sheet in cases where said plastic flange 121 and said flexible sheet are both made of a fusible material, e.g. plastics, such as polyethylene. Due to the plastic body 120 being an integral body enclosing the metal body 110, likewise being an integral body, the eyelet 100 experiences a significant strength compared to conventional eyelets. Especially, due to the plastic of the plastic body 120 occupying the partly confined space 115 defined by the first 113 and second flanges 114, a disconnection between said plastic body 120 and the metal body 110 is unlikely.

Figure 2:
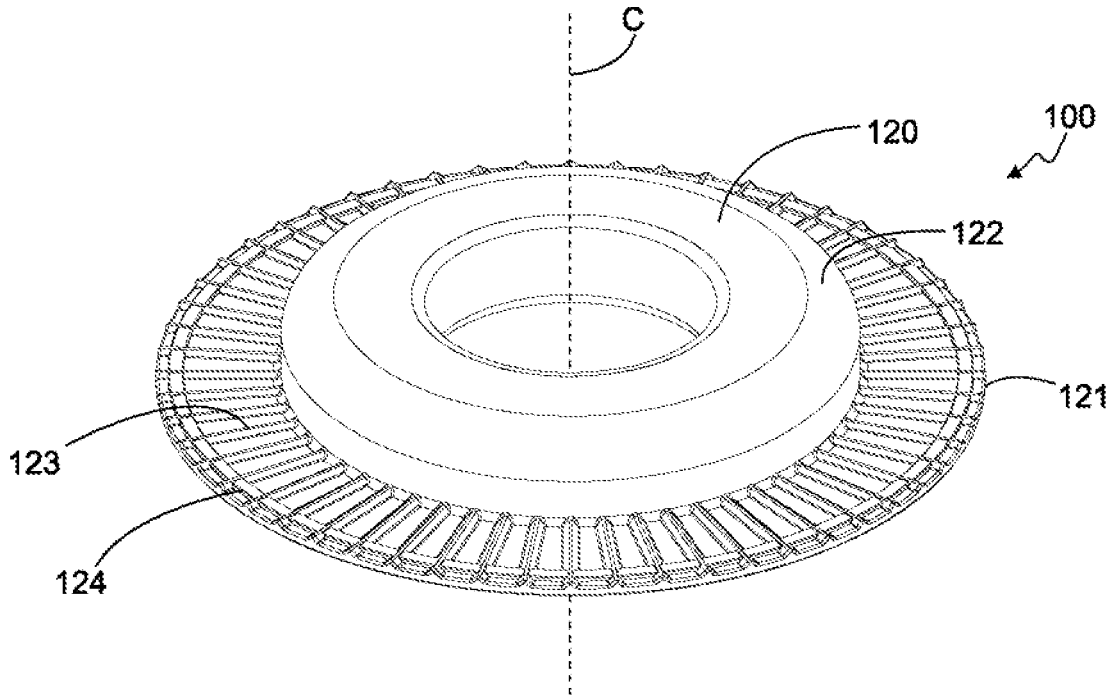
FIG. 2 illustrates a perspective view of an eyelet according to the invention comprising radially extending ribs according to the invention.

FIG. 2 illustrates a perspective view of an eyelet 100 according to the invention comprising radially extending ribs 123 provided in the plastic flange 121. The ribs 123 introduce corrugations in the surface of the plastic flange 121, which aids in a strong welding/fusion with a flexible sheet. The ribs 123 are radially extending away from the central axis C. A circular rib 124 may be provided along the edge of the plastic flange 121, the circular rib 124 being circular about the central axis C and thus perpendicular to the radially extending ribs 123.

Figure 3A:
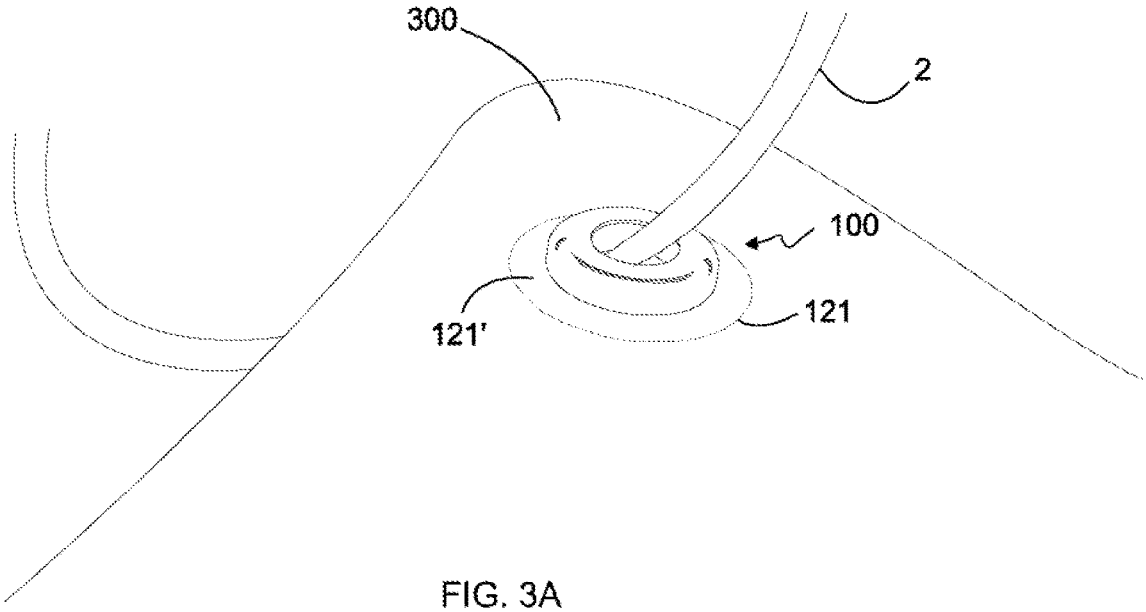
FIGS. 3A and 3B illustrate an eyelet attached to a flexible sheet according to the invention.
Figure 3B:
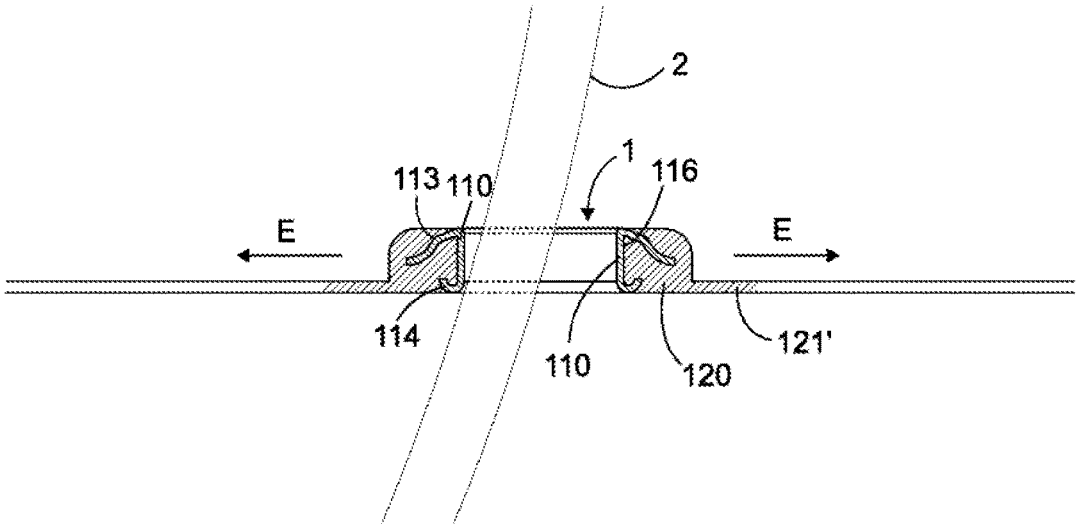
Figure 4A:
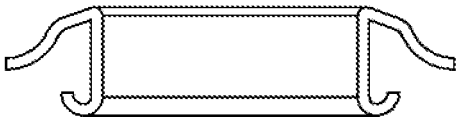
FIGS. 4A-4H illustrate different shapes of the first and the second flange on the metal body of an eyelet according to the present invention.
Figure 4B:
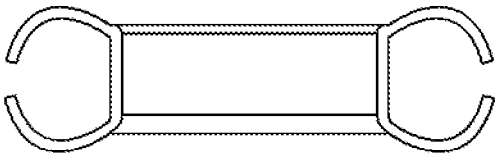
Figure 4C:
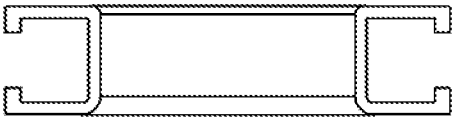
Figure 4D:
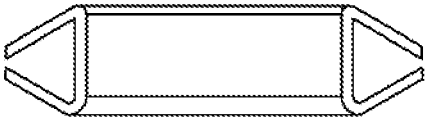
Figure 4E:
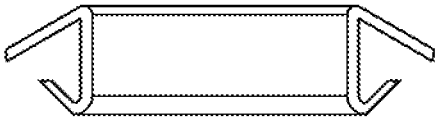
Figure 4F:
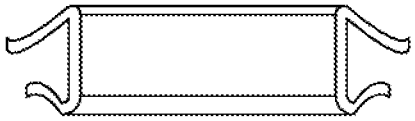
Figure 4G:
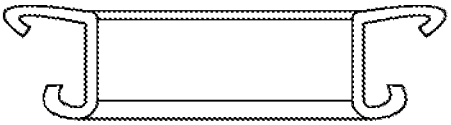
Figure 4H:
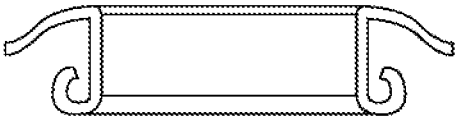

FIGS. 3A and 3B illustrate an eyelet 100 according to the invention attached to a flexible sheet 300. FIG. 3A illustrates a perspective view of a flexible sheet 300 comprising an eyelet 100. FIG. 3B illustrates a cross sectional view of the view in FIG. 3A. A rope 2 has been passed through the aperture 1 formed in the eyelet 100. The flexible sheet 300 is made of a synthetic material, such that said flexible sheet 300 may be welded/fused with the plastic flange 121 of the eyelet 100. The synthetic material of the flexible sheet 300 may for example be a type of polymer or plastic, e.g. PVC, polyurethane or PP. Preferably, the flexible sheet 300 and the plastic flange 121 of the eyelet 100 are made of the same material, such that an efficient welding zone 121' is formed. The welding zone 121' is coinciding with the plastic flange 121 and is indicated by the dashed outline of said plastic flange 121. Thus, the eyelet 100 may be considered an integral part of the flexible sheet 300. Thereby, the eyelet 100 may be securely fixed/attached to the flexible sheet 300. In combination with the build of the eyelet 100, where the plastic body 120 encloses the metal body 110, this creates a durable eyelet 100 less prone to tearing of the flexible sheet 300. Especially, the asymmetric orientation of the first 113 and second flange 114 increases the resistance of detachment between the plastic body and metal body when pulled in a direction normal to the outer wall of the metal body, as indicated by the arrows E.

FIGS. 4A-4H all illustrate different shapes of the first and the second flange on the metal body of an eyelet according to the present invention. All embodiments are different examples of a metal body as described in FIGS. 1A-1C comprising a cylindrical section comprising a first end and a second end. The first end is provided with a radially extending first flange extending towards the second, and the second end is provided with a radially extending second flange extending towards the first end. In all embodiments, a partly confined space is formed by the first and second flange and the cylindrical section.

REFERENCE NUMBERS

A-A Cross section
C Central axis
d First diameter
D Second diameter
E Direction of pull
V Angle related to First flange 113
W Angle related to Second flange 114
1 Central aperture
2 Rope
100 Eyelet
110 Metal body
111 First end of Cylindrical section 119
112 Second end of Cylindrical section 119
113 First flange
114 Second flange
115 Partly confined space
116 Outer wall of Cylindrical section 119
119 Cylindrical section
120 Plastic body
121 Plastic flange
122 Shoulder of Plastic body 120
123 Ribs
124 Circular rib
300 Flexible sheet

The invention claimed is:

1. An eyelet for a flexible sheet, wherein the flexible sheet is a tarpaulin, canvas, foil, or linen, the eyelet forming a round loop having a central aperture suitable for receiving a rope; wherein the eyelet comprises: a metal body comprising a cylindrical section comprising a first end and a second end, wherein the first end is provided with a radially extending first flange extending towards the second end, and wherein the second end is provided with a radially extending second flange extending towards the first end, such that a partly confined space is formed by the first and second flange and the cylindrical section, and a plastic body enclosing the metal body, whereby said plastic body is securely joined to the metal body due to plastic occupying at least the partly confined space, and wherein the plastic body comprises a radially extending plastic flange, thereby providing means for joining the eyelet to the flexible sheet.

2. The eyelet according to claim 1, wherein the first and second flanges and the plastic flange are rotationally symmetric about a central axis of the eyelet.

3. The eyelet according to claim 1, wherein the first flange extends further away from the cylindrical section than the second flange.

4. The eyelet according to claim 1, wherein the second flange is substantially U-shaped in cross section.

5. The eyelet according to claim 1, wherein the plastic flange extends further away from the cylindrical section than the first flange.

6. The eyelet according to claim 1, wherein the plastic flange is planar.

7. The eyelet according to claim 1, wherein the plastic flange comprises ribs.

8. A flexible sheet comprising an eyelet according to claim 1.

9. The eyelet according to claim 2, wherein the first flange extends further away from the cylindrical section than the second flange.

10. The eyelet according to claim 2, wherein the second flange is substantially U-shaped in cross section.

11. The eyelet according to claim 3, wherein the second flange is substantially U-shaped in cross section.

12. The eyelet according to claim 2, wherein the plastic flange extends further away from the cylindrical section than the first flange.

13. The eyelet according to claim 3, wherein the plastic flange extends further away from the cylindrical section than the first flange.

14. The eyelet according to claim 4, wherein the plastic flange extends further away from the cylindrical section than the first flange.

15. The eyelet according to claim 2, wherein the plastic flange is planar.

16. The eyelet according to claim 3, wherein the plastic flange is planar.

17. The eyelet according to claim 4, wherein the plastic flange is planar.

18. The eyelet according to claim 2, wherein the plastic flange comprises ribs.

19. The eyelet according to claim 3, wherein the plastic flange comprises ribs.

20. The eyelet according to claim 4, wherein the plastic flange comprises ribs.

* * * * *